US007231942B2

(12) United States Patent
Gesing

(10) Patent No.: US 7,231,942 B2
(45) Date of Patent: Jun. 19, 2007

(54) SHAFT ROD

(75) Inventor: Karl-Heinz Gesing, Raesfeld (DE)

(73) Assignee: Groz-Beckert KG, Albstadt (DE)

( * ) Notice: Subject to any disclaimer, the term of this patent is extended or adjusted under 35 U.S.C. 154(b) by 9 days.

(21) Appl. No.: 10/942,993

(22) Filed: Sep. 17, 2004

(65) Prior Publication Data

US 2005/0061385 A1 Mar. 24, 2005

(30) Foreign Application Priority Data

Sep. 18, 2003 (DE) ..... 103 43 159

(51) Int. Cl.
*D03C 9/06* (2006.01)

(52) U.S. Cl. ..... 139/91

(58) Field of Classification Search ..... 139/91–96, 139/82

See application file for complete search history.

(56) References Cited

U.S. PATENT DOCUMENTS 3,754,577 A * 8/1973 Heller ..... 139/92
4,484,604 A * 11/1984 Kramer et al. ..... 139/92
4,503,890 A * 3/1985 Kramer ..... 139/92
4,633,916 A * 1/1987 Rast ..... 139/92
4,913,193 A 4/1990 Faasse
4,913,194 A * 4/1990 Kramer ..... 139/91

FOREIGN PATENT DOCUMENTS

| | | |
|---|---|---|
| CH | 488 035 | 5/1970 |
| DE | 39 37 657 A1 | 6/1990 |
| EP | 0 008 793 | 3/1980 |

* cited by examiner

*Primary Examiner*—Gary Welch
*Assistant Examiner*—Andrew W. Sutton
(74) *Attorney, Agent, or Firm*—Norman N. Kunitz; Fitch, Even, Tabin & Flannery

(57) ABSTRACT

A shaft rod for a heddle shaft is formed by a profile body (15) and an associated additional profile body, which are joined together by a detent means (25) and additionally by an adhesive bond. The detent means (25) is embodied such that it already holds the additional profile body (19) fixed and in the correct position on the profile body (15) when the adhesive that forms the adhesive seam (33) is still liquid or viscous, or in any case has not yet thoroughly hardened. This provision makes it substantially easier to manipulate the shaft rod (4) during manufacture.

11 Claims, 4 Drawing Sheets

SHAFT ROD

CROSS REFERENCE TO RELATED APPLICATION

This application claims the priority of German Patent Application No. 103 43 159.4, filed on Sep. 18, 2003, the subject matter of which, in its entirety, is incorporated herein by reference.

FIELD OF THE INVENTION

The invention relates to a shaft rod for heddle shafts of power looms.

BACKGROUND OF THE INVENTION

It is known for shaft rods for constructing heddle shafts to be embodied of hollow profiles provided with reinforcing strips. Swiss Patent CH 525 352, for instance, discloses one such shaft rod in the form of a lightweight metal hollow profile, to the edges of which reinforcing rods of high-quality steel are glued. Gluing the steel profiles into appropriate recesses in the lightweight metal hollow profile is a work process that must be performed carefully and in which the steel profile must be fixed on the lightweight metal hollow profile until the adhesive hardens.

German Patent Disclosure DE 39 37 657 A1 likewise discloses a shaft rod with reinforcing profiles. They are placed in hollow chambers in the shaft rod, which is constructed of multiple parts, and are fixed there with the aid of an epoxy resin adhesive or the like. The multi-part construction of the shaft rod makes considerable demands in terms of manufacture.

From European Patent Disclosure EP 0 008 793 A1, it is also known for a plastic shaft rod to be provided with a metal profile rail on its short side. This rail has one or more anchoring pegs, which protrude into an inner chamber enclosed by the plastic shaft rod. The anchoring pegs are clamped between arms of the shaft rod. The arms are profiled on the inside, and with striplike protrusions they engage recesses in the peg. The pegs are held with considerable axial play. The securing of the metal profile rod is then done with adhesive.

SUMMARY OF THE INVENTION

It is the object of the invention to create a shaft rod for power looms which can be produced by an economical production process with high process reliability.

The above object generally is achieved by the shaft rod of the invention, which is essentially formed by a profile body which is joined to an additional profile body. An adhesive seam is used for this, by way of which the additional profile body is attached over as large a surface area as possible to the profile body. The special feature of the shaft rod of the invention is a detent means, with which the additional profile body is fixed and thus secured to the profile body in its desired position as long as the adhesive seam has not yet hardened. Because of the thus-positive fixation of the additional profile body to the profile body, external means for fixing the parts to be joined, means that are otherwise necessary to secure a fresh adhesive seam that is not yet thoroughly hardened, become superfluous. Thus a simple, reliable production process can be established. It suffices to make a bead of adhesive on the additional profile body or on the profile body. When the profile body and additional profile body are joined together, the detent means causes the additional profile body and profile body to be pulled together, spreading out the bead of adhesive, so that the adhesive seam is created over a large area. The profile body and additional profile body are then kept fixed in the desired position by the detent means until the adhesive has hardened. Because of the fixation of the adhesive seam, the shaft rod can already be manipulated in this state, which makes production easy and reliable.

The profile body and the additional profile body are preferably embodied complementary to one another, in the sense that one of the two bodies has a recess, and the other of the two bodies has a protrusion that fits the recess. Instead of a protrusion of one of the bodies involved that engages a recess of the other body, it is also possible for the additional profile body itself to be placed in a suitable recess and thus snapped into place. It is a common feature of all the embodiments in the sense that by the cooperation of the profile of the profile body with the profile of the additional profile body, a snap connection is embodied that achieves a nonpositive and/or positive fixation of the adhesive seam.

In a preferred embodiment, at least one protrusion, embodied for instance as one or more longitudinally continuous strips or ribs, is formed on the profile body and/or on the additional profile body; these strips or ribs extend through the adhesive seam and thus form a linear or striplike contact face, in which the bodies rest against one another. These protrusions thus determine the thickness of the adhesive seam, which in this way can be established reliably in the process, without requiring additional provisions. Thus both overly wide and overly narrow adhesive seams can be avoided. The thickness of the adhesive seam is decisive for the strength of the adhesive bond. Thus these protrusions assure the quality of the final product.

The detent means is preferably embodied such that it exerts pressure on the adhesive seam. The profile body and the additional profile body are then held without play against one another, regardless of whether the adhesive has already hardened. The play-free retention or bearing is attained because the detent means in a certain sense pulls the additional profile body tightly against the profile body. This also affords the possibility of leaving the adhesive seam open, that is, of making do without adhesive, for instance if the additional profile body is simply a covering profile.

Arms of the profile body for instance embrace the additional profile body, or portions of it, in a C shape and thus pull it firmly into the jaw that they form, when it is introduced into the receiving chamber that remains between the arms. These arms or other detent means then have at least one pressure face, pointing obliquely to the insertion direction and into the inner chamber, and this pressure face exerts a force, acting in the insertion direction, on the profile body in order to press it against a contact face.

A further provision that contributes to production reliability is that a receiving chamber for excess adhesive displaced out of the adhesive seam is provided on the additional profile body, on the profile body, or between the two. Such a receiving chamber prevents adhesive that spills over from escaping and having to be removed. Once again, this contributes to production reliability.

The profile body is formed for instance by a lightweight metal profile, such as an extruded aluminum profile. However, it can also be formed by a plastic hollow profile or some other kind of profile, such as molded metal sheets. The additional profile body provides reinforcement, for instance, and can be produced as a solid or hollow profile, in each case from suitable materials, with various moduli of elasticity.

The additional profile body can for instance be a steel body, CFK body (fiber-reinforced plastic body), or something similar. For short shafts that run at high speed, CFK round profiles with a very high modulus of elasticity can be considered. For long, low-speed shafts, steel pipe profiles or CFK round profiles with a lower modulus of elasticity may be used. When the loads are very slight, even a plastic tubular profile may be clipped into the receiving chamber of the profile body to protect against dust. It is then secured by the detent means. Gluing can then be dispensed with.

It is considered advantageous for the additional profile body to be glued over its entire length to the profile body. In many cases, however, it can suffice to glue the additional profile body only in some portions to the profile body, for instance on its ends or in short portions spaced apart from one another.

Further details of advantageous embodiments of the invention will become apparent from the drawing, description, or claims. In the drawing, exemplary embodiments of the invention are shown.

DETAILED DESCRIPTION OF THE INVENTION

Figure 1:
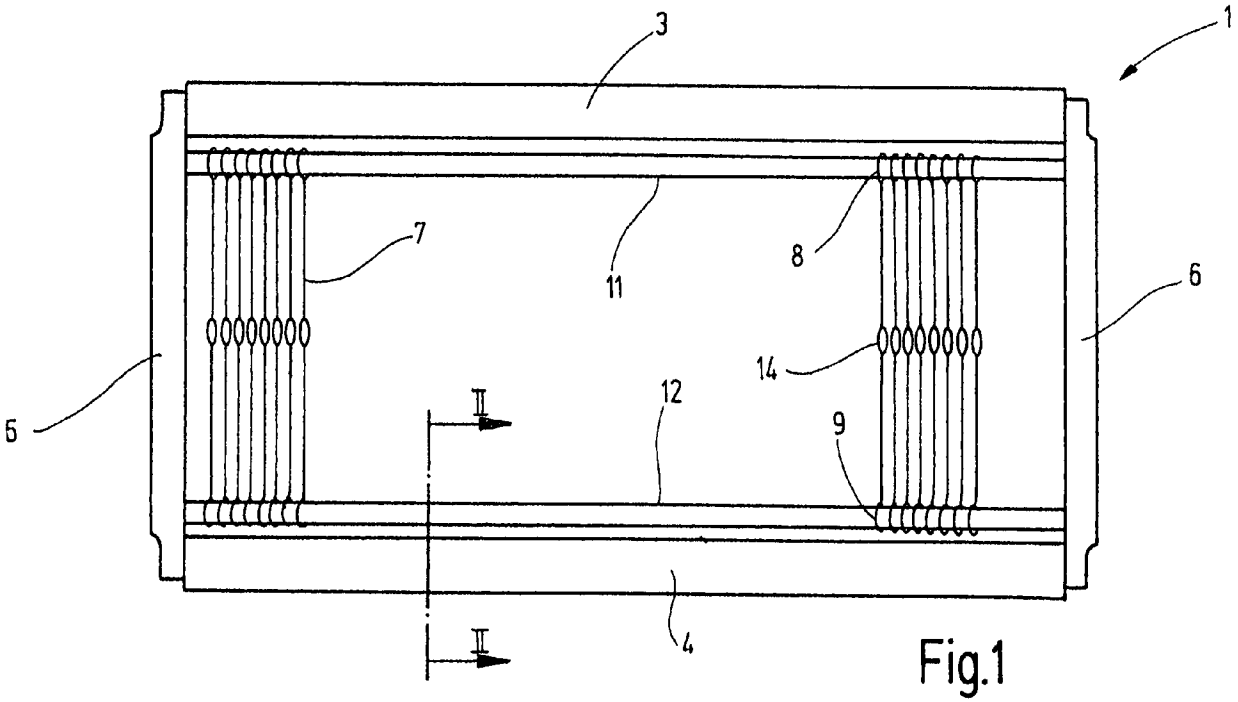
FIG. 1 is a schematic front view of a heddle shaft.

In FIG. 1, a heddle shaft 1 is shown for a power loom, not otherwise shown. The heddle shaft is formed by a frame, which includes an upper shaft rod 3, a lower shaft rod 4, and side struts 5, 6. Between the shaft rods 3, 4, heddles 7 are retained, which are seated with their end eyelets 8, 9 on heddle support rails 11, 12. These rails are retained on the shaft rods 3, 4. The heddles 7 serve to move warp yarns, which extend through the yarn eyelets 14, up or down in order to form the weaving shed.

Figure 2:
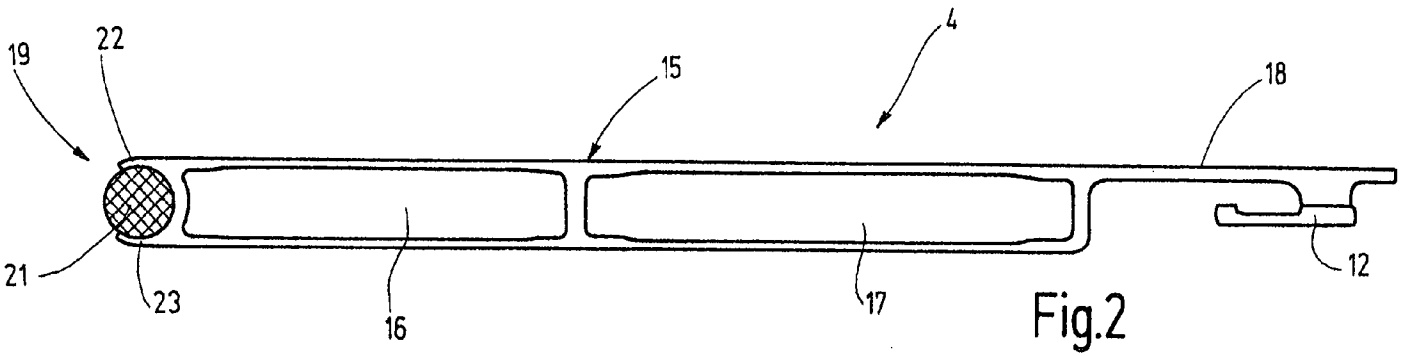
FIG. 2 is a section taken along the line II—II through the lower shaft rod of the heddle shaft of FIG. 1.

The shaft rod 4 shown in section along the line II—II is shown separately in FIG. 2. At least within the context of the ensuing description, it matches the shaft rod 3, so that the description applies accordingly to both shaft rods 3, 4.

The shaft rod 4 is formed essentially by a profile body 15, for instance in the form of an extruded aluminum profile. Preferably, the profile body 15 is a hollow profile body, with one or more chambers 16, 17, which are extensively or entirely closed off from the outside and are either hollow, or in other words empty, or filled with a plastic foam or some other filler material. The profile body 15 is a flat body, whose basic outline is essentially rectangular. A wall-like stem 18 extends away from a short side and bears the heddle support rail 12. On the opposite short side, an additional profile body 19 is retained, in the form of a reinforcing profile. In the present exemplary embodiment, it is formed by a round solid profile body 21, which is solidly joined to the profile body 15. The solid profile body 21 has a circular cross-sectional profile, for instance, and it extends over the full length of the profile body 15. The solid profile body 21 may be of steel or some other material with tensile and compressive strength. For example, and preferably, it is formed by a fiber-reinforced plastic body, a glass-fiber-reinforced plastic body, or a carbon-fiber-reinforced plastic body. The fibers preferably extend in the longitudinal direction of the profile body (in FIG. 2, perpendicular to the plane of the drawing).

Figure 3:
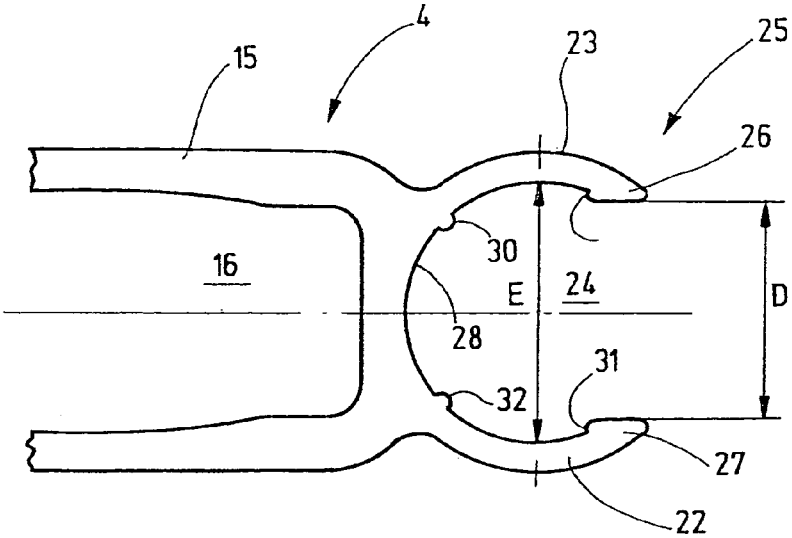
FIG. 3 is a fragmentary, intermittent sectional view of the shaft rod of FIG. 2 without a reinforcing profile.

For supporting the solid profile body 21, the profile body 15 has two arms 22, 23, embracing the solid profile body 21 in parenthesis-like fashion, which define a C-shaped inner chamber 24 that can be seen in FIG. 3. Together and in combination with the solid profile body 21, they form a detent means 25, which keeps the solid profile body 21 fixed in stationary fashion and prestressed in the receiving chamber (interior chamber) 24. The width D, which is defined between the front free ends 26, 27 of the arms 22, 23, is less than the diameter of the solid profile body 21 and moreover less than the greatest inner width E of the inner chamber 24 (FIG. 3), measured in the same direction.

Figure 5:
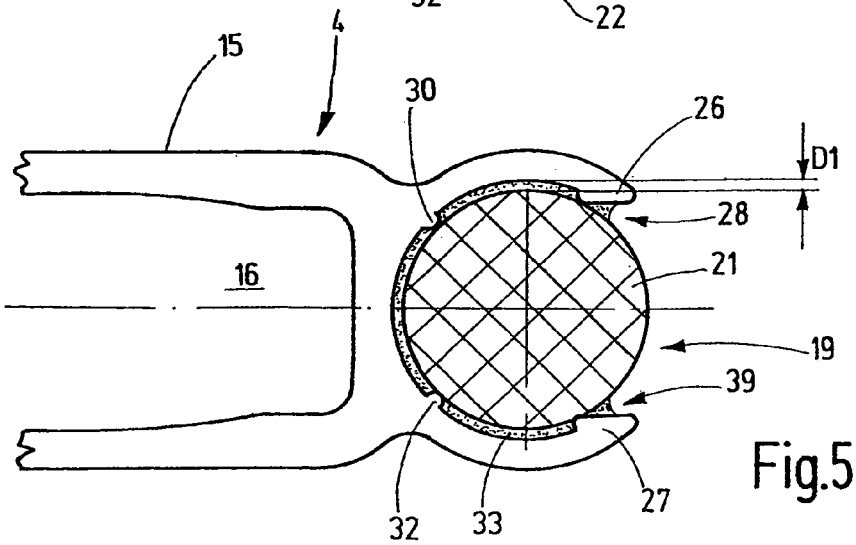
FIG. 5 is a fragmentary sectional view of the shaft rod of FIG. 2 with the reinforcing profile glued in place.

The wall 28 defining the inner chamber 24 is embodied essentially cylindrically. From the wall 28, protrusions 29, 30, 31, 32 protrude into the inner chamber 24. These protrusions 29, 30, 31, 32 take the form of elongated ribs, extending in the longitudinal direction of the profile body, which as FIG. 5 shows protrude through an adhesive gap or adhesive seam 33 that develops between the solid profile body 21 and the profile body 15. Thus the height of the protrusions 29, 30, 31, 32 determines the thickness D1 of the adhesive seam 33. The protrusions 29, 30, 31, 32 may, as noted, be formed as ribs, that is, longitudinally continuous ribs, or lobes of some other kind, interrupted lobes, or bumps. Alternatively, they may be embodied on the solid profile body 21 instead.

Figure 4:
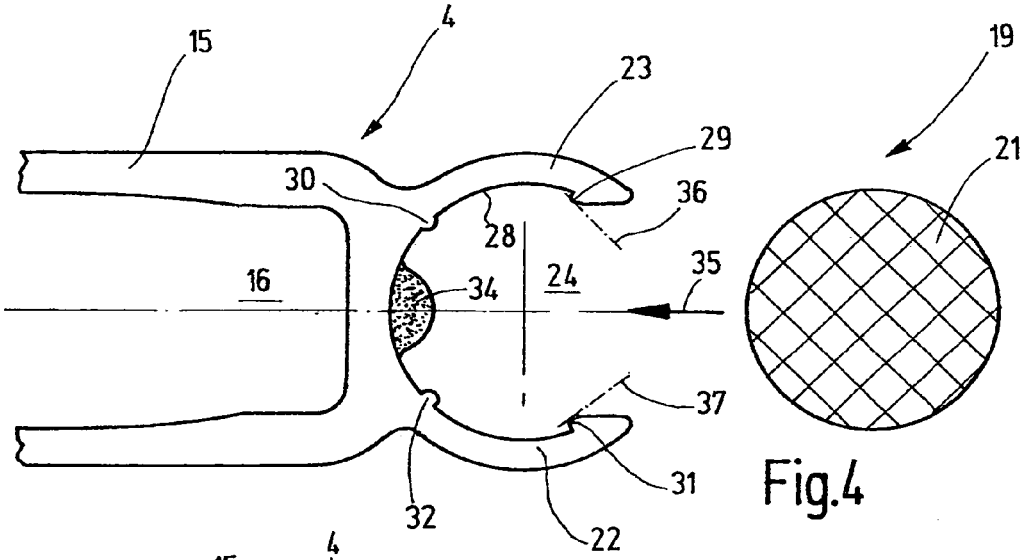
FIG. 4 is a fragmentary sectional view of the shaft rod of FIG. 3 during the introduction of the reinforcing profile.

The assembly of the shaft rod 4 proceeds as follows:

As FIG. 4 shows, at a suitable point on the wall 28, for instance on its bottom, a bead of adhesive 34 is first deposited. This can be done by means of a suitable automatic dispenser. The bead of adhesive 34 may be embodied as either continuous or interrupted in the longitudinal direction of the shaft (in FIGS. 4 and 11, perpendicular to the plane of the drawing). Once this has been done, the round profile 21 is introduced into the inner chamber 24 in the insertion direction 35 represented by an arrow in FIG. 4. This can be done either simultaneously over the entire length of the solid profile body 21 or progressively from one end to the other, depending on the rigidity of the solid profile body 21. Depending on the ratio of the rigidity of the arms 22, 23 to the modulus of elasticity of the round profile rod 21, the arms 22, 23 temporarily spread apart so as to receive the solid profile body 21, or else the latter deforms somewhat so that it can fit through the narrow entrance, defined between the ends 26, 27, to reach the inner chamber 24. As soon as it is behind the oblique faces, which can be seen at the protrusions 29, 31 by means of their tangents 36, 37, the force that is operative transversely to the insertion direction 35 between the solid profile body 21 and the arms 22, 23 is converted into a force that is operative in the insertion direction 35. The pressure faces, represented by the tangents 36, 37, at the protrusions 29, 31 may be embodied as flat or rounded. Preferably, they are oriented at a more or less acute angle to the insertion direction 35. The protrusions 30, 32, conversely, form contact faces for the solid profile body 21. They are oriented obliquely to the insertion direction 35 and jointly act like a stop oriented transversely to the insertion direction 35. Once the solid profile body 21 is far enough into the inner chamber 24 that it reaches the bead of adhesive 34, it presses the bead of adhesive in the adhesive seam 33 that develops out thinly, so that the adhesive is distributed over the entire seam and finally emerges between the ends 26, 27. The nips 38, 39 formed here between the solid profile body 21 and the ends 26, 27 form receiving chambers for the adhesive that may have emerged. The extent to which these receiving chambers fill with adhesive does not matter. A buffer volume is thus created, which if the bead of adhesive 34 proves to be somewhat more voluminous than necessary can receive excessive adhesive. However, this does not affect the thickness D1 of the adhesive seam; it is determined solely by the height of the protrusions 29, 30, 31, 32.

Once the solid profile body 21 has been inserted into the receiving chamber 24, it is held securely in place by the action of the detent means 25. The detent means 25 presses the solid profile body 21 against the protrusions 30, 32. The shaft rod 4 can therefore be manipulated further in the course of the production process without special precautionary provisions and without the otherwise required minimal curing or hardening time of the adhesive. No external means for fixing the solid profile body 21 are needed. Once the adhesive in the adhesive seam 33 has hardened, an axially solid bond is established between the profile body 15 and the solid profile body 21. The shaft rod 4 can then be delivered for use or for further processing.

Figure 6:
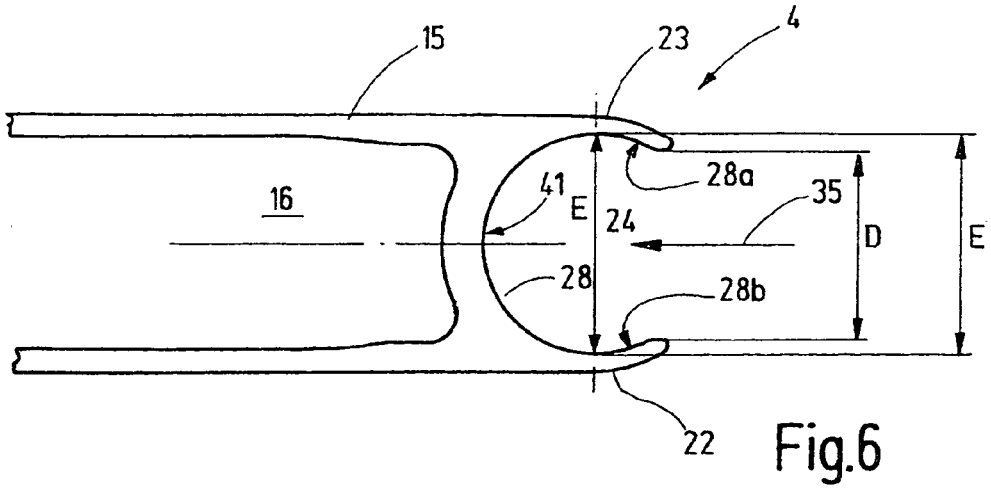
FIG. 6 is a fragmentary sectional view of a modified embodiment of a shaft rod.

FIG. 6 illustrates a simplified embodiment of the profile body 15. In it, the protrusions 29, 30, 31, 32 have been dispensed with. The oblique faces for pulling the solid profile body 21 into the inner chamber 24 are formed by the outer portions 28*a*, 28*b* of the wall 28, which engage the diameter E from behind. The wall portions 28*a*, 28*b* form curved face portions that engage the solid profile body 21 from behind and press the solid profile body 21 into the inner chamber and thus in particular against a region 41 of the wall 28 that is perpendicular to the insertion direction 35. Otherwise, reference may be made to the preceding description. The thickness of the adhesive seam may be determined by fillers or filler bodies, such as glass beads, that are added to the adhesive. This is especially advantageous in an embodiment without protrusions 29, 30, 31, 32.

Figure 7:
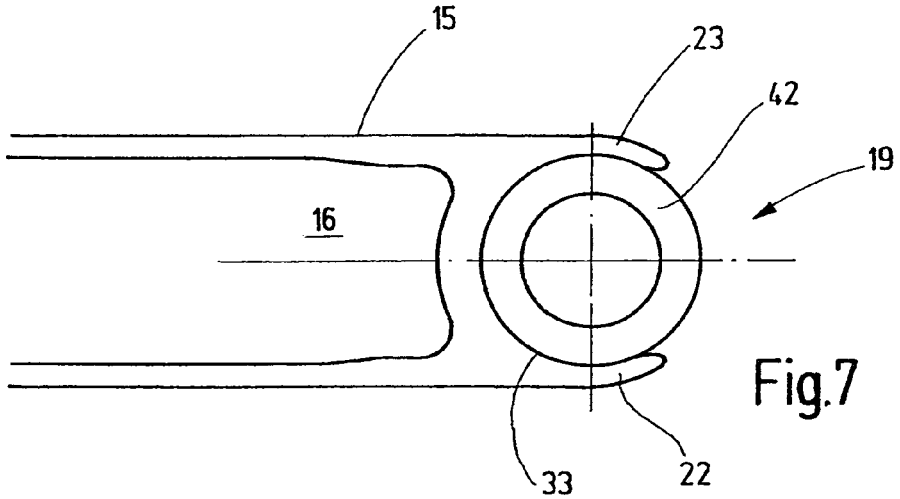
FIGS. 7 and 8 show the shaft rod of FIG. 6 with different reinforcing profiles.

FIG. 7 shows the bearing of an additional profile body 19, embodied as a hollow profile body (tubular profile body) 42, which like the solid profile body 21 described above is seated in the receiving chamber between the arms 22, 23. It can be retained in the adhesive seam 33 by adhesive. If the tubular profile body 42 is not a reinforcing profile, however, but only a filling profile, then the adhesive can be omitted. This is suitable for instance for low-speed heddle shafts, in which the only criterion is to close off the inner chamber 24 to avoid accumulations of dust.

Figure 8:
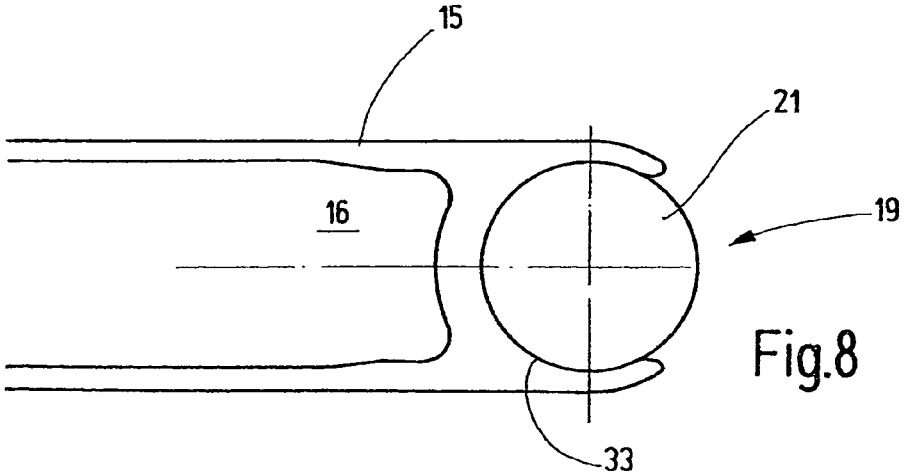

FIG. 8 shows the bearing of the solid profile body 21 in the profile body 15 of FIG. 6. The adhesive seam 33 here is relatively thin. This embodiment is especially suitable for the use of low-viscosity adhesives with a low capacity to fill gaps.

Figure 9:
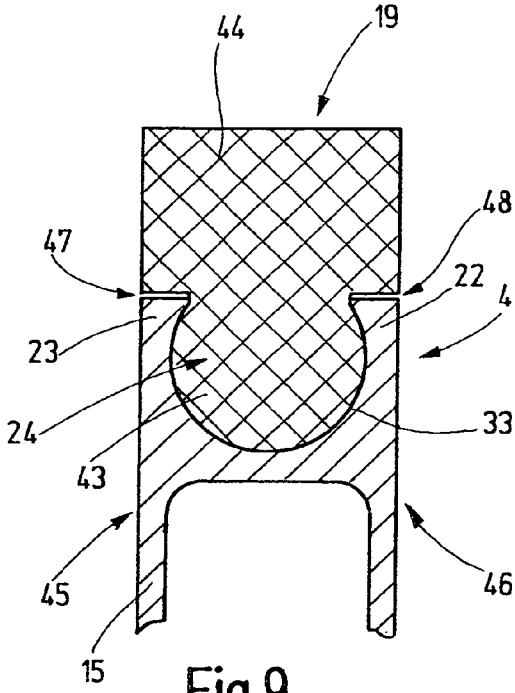

While in the embodiments described above the additional profile body 19 has been introduced extensively, that is, to beyond its own diameter, into the profile body 15, FIG. 9 shows an embodiment of a shaft rod 4 in which a detent portion 43 is embodied on the additional profile body 19 and is seated in the C-shaped inner chamber 24 between the arms 22, 23. The detent portion 43 has a shape to be engaged from behind by the arms 22, 23, so that like the solid profile body 21 or the tubular profile body 42, it is retained stationary and fixed between the arms 22, 23, even if adhesive in the adhesive seam 33 is still liquid.

The additional profile body 19 may, as shown in FIG. 9, have an end portion 44, adjoining the detent portion 43, of rectangular or square cross section, or of some other shape, such as half-round. Preferably, these flanks adjoin the flat sides 45, 46 of the profile body 15 without graduations. However, it is also possible to provide graduations here. A gap 47, 48 with parallel flanks or defined by an acute angle that remains between the end portion 44 and the face ends of the arms 22, 23 may serve as a receiving chamber and buffer space for adhesive that is spilling out.

Figure 10:
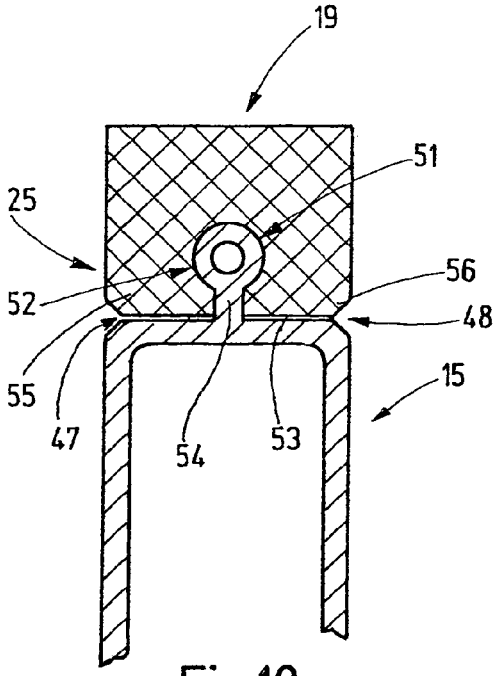
FIGS. 9 through 11 show further embodiments, in each case in fragmentary sectional views, of the shaft rod and the reinforcing profile.

FIG. 10 shows a further-modified embodiment, in which the additional profile body 19 has a receiving chamber 51 whose function is equivalent to that of the receiving chamber 24. It serves to receive a detent portion 52 which is embodied as a longitudinally continuous or interrupted rib disposed on the short side 53 of the profile body 15. This rib has an undercut cross section, and the stem 54 connecting it to the short side 53 is narrower than its diameter. Thus it can be embraced by arms 55, 56 of the additional profile body 19 that define the receiving chamber 51.

In this embodiment, the bead of adhesive may be placed on the bottom of the receiving chamber 51 before the additional profile body 19 is secured to the profile body 15. However, it is also possible to deposit the bead of adhesive on the upper apex of the detent portion 52. In both cases, adhesive that spills out is forced into the gap 47, 48 between the additional profile body 19 and the profile body 15. Nip regions on the outside may serve as buffers here. Corresponding nip regions may also be provided in the exemplary embodiment of FIG. 9.

Figure 11:
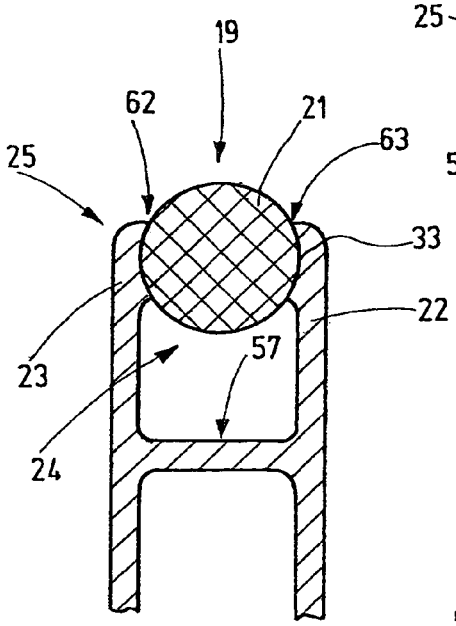
Figure 12:
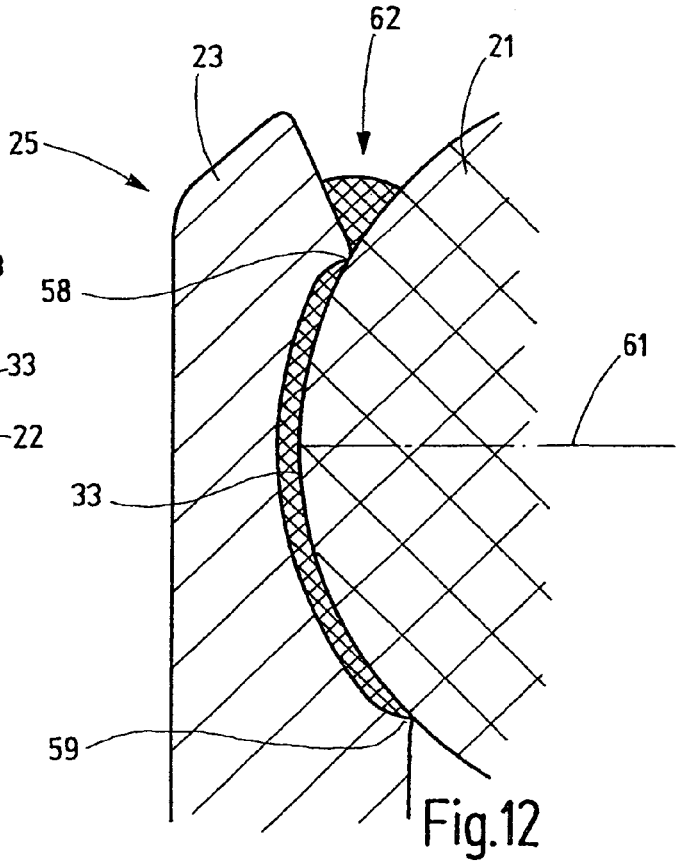
FIG. 12 is a fragmentary sectional view on a different scale of the shaft rod of FIG. 11.

A further variant embodiment is shown in FIGS. 11 and 12. The special feature here is that the additional profile body 19, for instance in the form of the solid profile body 21, is retained between two concave faces of the arms 22, 23 without resting on the bottom 57 of the inner chamber 24. Nevertheless, the arms 22, 23 form a detent means that holds the solid profile body 21 in stationary fashion as long as the adhesive in the adhesive seam 33 is still liquid. As FIG. 12 shows, the concave faces embodied on the arms 22, 23 may again be provided with protrusions 58, 59, which are disposed on both sides of the equator 61 that is to be measured perpendicular to the arms 22, 23. Thus the cylindrical solid profile body 21 is snapped into place between the arms 22, 23 and fixed in the correct position. Beads of adhesive that were applied to the respective arms 22, 23 between the protrusions 58, 59 are spread flat as the solid profile body 21 is introduced into the inner chamber 24 and spill in part outward. A nip 62, 63 embodied between the arm 22, 23, respectively, and the solid profile body 21 forms the receiving chamber for more or less large quantities of adhesive that spill out.

A shaft rod for a heddle shaft is formed by a profile body 15 and an associated additional profile body, which are joined together by a detent means 25 and additionally by an adhesive bond. The detent means 25 is embodied such that it already holds the additional profile body 19 fixed and in the correct position on the profile body 15 when the adhesive that forms the adhesive seam 33 is still liquid or viscous, or in any case has not yet thoroughly hardened. This provision makes it substantially easier to manipulate the shaft rod 4 during manufacture.

It will be appreciated that the above description of the present invention is susceptible to various modifications, changes and adaptations, and the same are intended to be comprehended within the meaning and range of equivalents of the appended claims.

List of Reference Numerals:

1 Heddle shaft
3, 4 Shaft rod
5, 6 Side struts
7 Heddles
8, 9 End eyelets
11, 12 Heddle support rail
14 Yarn eyelet
15 Profile body
16, 17 Chambers
18 Stem
19 Additional profile body
21 Solid profile body
22, 23 Arms
24 Inner chamber
25 Detent means
26, 27 Ends
28 Wall
29, 30, 31, 32 Protrusions
33 Adhesive seam
34 Bead of adhesive
35 Insertion direction
36, 37 Tangents
38, 39 Nips=receiving chambers
41 Wall region
42 Tubular profile body
43 Detent portion
44 End portion
45, 46 Flat sides
47, 48 Gap
51 Receiving chamber
52 Detent portion
53 Short side
54 Stem
55, 56 Arms
57 Bottom
58, 59 Protrusions
61 Equator
62, 63 Nips
D Width
D1 Thickness
E Width, diameter

What is claimed is:

1. A shaft rod for heddle shafts for power looms, having a profile body, which has an elongated receiving chamber for an additional profile body which is joined to the profile body via an adhesive seam, wherein a detent means that is operative between the profile body and the additional profile body is provided, which when the adhesive seam has not yet thoroughly hardened, fixes the additional profile body relative to the profile body in a desired position; wherein at least one protrusion, which extends through the adhesive seam, is disposed on at least one of the profile body and the additional profile body within the chamber; and wherein the detent means exerts pressure on the adhesive seam.

2. The shaft rod of claim 1, wherein the profile body and the additional profile body are embodied as complementary to one another.

3. The shaft rod of claim 1, wherein the protrusion is a longitudinally extending rib.

4. A shaft rod for heddle shafts for power looms, having a profile body, which has an elongated receiving chamber for an additional profile body which is joined to the profile body via an adhesive seam, wherein a detent means that is operative between the profile body and the additional profile body is provided, which when the adhesive seam has not yet thoroughly hardened, fixes the additional profile body relative to the profile body in a desired position; wherein at least one protrusion, which extends through the adhesive seam, is disposed on at least one of the profile body and the additional profile body within the chamber; and wherein the detent means is formed by two arms of the profile body, which embrace the additional profile body, or a portion thereof, and have an orifice width (D) which is less than the width (E) of the inner chamber that they embrace.

5. A shaft rod for heddle shafts for power looms, having a profile body, which has an elongated receiving chamber for an additional profile body which is joined to the profile body via an adhesive seam, wherein a detent means that is operative between the profile body and the additional profile body is provided, which when the adhesive seam has not yet thoroughly hardened fixes the additional profile body relative to the profile body in a desired position; and wherein the detent means is formed by two arms of the additional profile body which embrace a detent portion of the profile body, and have an orifice width (D) which is less than the width (E) of the inner chamber that they embrace.

6. A shaft rod for heddle shafts for power looms, having a profile body, which has an elongated receiving chamber for an additional profile body which is joined to the profile body via an adhesive seam, wherein a detent means that is operative between the profile body and the additional profile body is provided, which when the adhesive seam has not yet thoroughly hardened, fixes the additional profile body relative to the profile body in a desired position; wherein at least one protrusion, which extends through the adhesive seam, is disposed on at least one of the profile body and the additional profile body within the chamber; and wherein the detent means has at least one pressure face, which is oblique to the insertion direction, with this face exerting a force, acting in the insertion direction, on the additional profile body and pressing it against a contact face that is oriented transversely to the insertion direction.

7. A shaft rod for heddle shafts for power looms, having a profile body, which has an elongated receiving chamber for an additional profile body which is joined to the profile body via an adhesive seam, wherein a detent means that is operative between the profile body and the additional profile body is provided, which when the adhesive seam has not yet thoroughly hardened fixes the additional profile body relative to the profile body in a desired position; and wherein between the profile body and the additional profile body, receiving chambers for excess adhesive forced out of the adhesive seam are provided.

8. A shaft rod for heddle shafts for power looms, having a profile body, which has an elongated receiving chamber for an additional profile body which is joined to the profile body via an adhesive seam, wherein a detent means that is operative between the profile body and the additional profile body is provided, which when the adhesive seam has not yet thoroughly hardened fixes the additional profile body relative to the profile body in a desired position; and wherein:

the profile body has an essentially rectangular shape in cross-section with a stem extending from a first narrow side of the cross-section for mounting of a heddle support rail; the detent means and the elongated receiving chamber are disposed on a narrow side of the cross-section opposite the first narrow side and extend along the length of the shaft rod; and the additional profile body is a stiffening profile body for longitudinal stresses in the shaft rod.

9. A shaft rod for heddle shafts for power looms, having a profile body, which has an elongated receiving chamber for an additional profile body which is joined to the profile body via an adhesive seam, wherein a detent means that is operative between the profile body and the additional profile body is provided, which when the adhesive seam has not yet thoroughly hardened fixes the additional profile body relative to the profile body in a desired position; and wherein the additional profile body is circular in cross-section, and the detent means is C-shaped in cross-section.

10. The shaft rod of claim 9, wherein the detent means is embodied such that the profile body and the additional profile body are held against one another without play.

11. A power loom having at least one heddle shaft that has a shaft rod as defined in claim 9.

* * * * *